United States Patent [19]

Matsubara et al.

[11] Patent Number: 4,714,418

[45] Date of Patent: Dec. 22, 1987

[54] SCREW TYPE VACUUM PUMP

[75] Inventors: Katsumi Matsubara; Riichi Uchida; Masatoshi Muramatsu, all of Ibaraki; Kotaro Naya, Ebina; Tsuneharu Takagi, Yokohama, all of Japan

[73] Assignee: Hitachi, Ltd., Tokyo, Japan

[21] Appl. No.: 701,199

[22] Filed: Feb. 13, 1985

[30] Foreign Application Priority Data

Apr. 11, 1984 [JP] Japan ..... 59-70830
Dec. 26, 1984 [JP] Japan ..... 59-272860

[51] Int. Cl.[4] ..... F04C 18/16
[52] U.S. Cl. ..... 418/201
[58] Field of Search ..... 418/201-206

[56] References Cited

U.S. PATENT DOCUMENTS

| | | | |
|---|---|---|---|
| 1,191,423 | 7/1916 | Holdaway | 418/201 |
| 2,474,653 | 6/1949 | Boestad | 418/201 |
| 2,931,308 | 4/1960 | Luthi | 418/201 |
| 3,088,659 | 5/1963 | Nilsson | 418/201 |
| 3,112,869 | 12/1963 | Aschoff | 418/201 |
| 3,289,600 | 12/1966 | Whitfield | 418/201 |
| 3,986,801 | 10/1976 | Garland | 418/201 |
| 4,193,749 | 3/1980 | Yamazaki | 418/201 |
| 4,412,796 | 11/1983 | Bowman | 418/201 |

FOREIGN PATENT DOCUMENTS

| | | | |
|---|---|---|---|
| 275706 | 2/1969 | Austria . | |
| 1332301 | 6/1963 | France | 418/201 |
| 393617 | 11/1965 | Switzerland . | |

OTHER PUBLICATIONS

European Search Report EP 85101569.3.

*Primary Examiner*—Carlton R. Croyle
*Assistant Examiner*—Jane E. Obee
*Attorney, Agent, or Firm*—Antonelli, Terry & Wands

[57] ABSTRACT

A screw vacuum pump including a plurality of casings and a pair of rotors defining a plurality of working chambers. The working chambers are constituted by working chambers whose volumes undergo a change as the rotors rotate, and working chambers whose volumes undergo substantially no change as the rotors rotate. The screw vacuum pump is capable of achieving pressure of $10^{-1}$ to $10^{-4}$ Torr or a low or medium vacuum by means of a single pump operating in a single stage.

19 Claims, 11 Drawing Figures

SCREW TYPE VACUUM PUMP

BACKGROUND OF THE INVENTION

This invention relates to a screw type vacuum pump for evacuating a closed chamber to produce a vacuum therein.

Various types of vacuum pumps, such as an oil-sealed rotary pump, a Roots mechanical booster pump, an ejector pump and a diffusion pump, have been in use to obtain medium and rough vacuum in which pressures are higher than about $10^{-4}$ Torr. The vacuum pumps and vacuum systems of the prior art have had a number of problems.

More particularly, the vacuum pump has a narrow range of operation pressures, and it is impossible for a single vacuum pump to operate a pressure range from 760 to $10^{-4}$ Torr level. The oil-sealed rotary pump is practically the only vacuum pump that is capable of operation with the backing pressure at the atmospheric pressure level, and almost all other vacuum pumps are incapable of operation unless the backing pressure is below 10 Torr. This makes it necessary to use an oil-sealed rotary pump in two stages or to use an oil-sealed rotary pump and another pump, such as a Roots pump as a mechanical booster pump, when one desires to achieve ultimate pressures of $10^{-1}$ to $10^{-4}$ Torr in a semiconductor manufacturing apparatus, such as a CVD (chemical vapor deposition) chamber. FIG. 1 shows one example of the prior art vacuum system in which an oil-sealed rotary pump 2 is used as a main process pump for evacuating the vacuum chamber 1 and a mechanical booster pump 3 is used in combination with the oil-sealed rotary pump 2 to achieve the desired level of pressure. In this example, when the pressure in a vacuum chamber 1 is high, a valve 5 is opened, valves 6 and 7 are closed while the oil-sealed rotary pump 2 is actuated to perform evacuation. Then, the valve 5 is closed and the valves 6, 7 are opened when the pressure in the chamber 1 is reduced to a level of less than 10 Torr in which the mechanical booster pump 3 is capable of operation, so that the evacuation operation can be continued by the oil-sealed rotary pump 2 and the mechanical booster pump 3 operating in series with each other. This type of vacuum system of the prior art suffers the disadvantages that it is complex in construction and high in cost, and that the operation of opening and closing the valves is troublesome.

In an oil-sealed rotary pump, a working chamber thereof is full of oil, so that there is the risk that the back-streaming of oil molecules may reduce the level of a vacuum or contaminate the vacuum system. To avoid this problem, it is necessary to mount an oil-trap 4 between the oil-sealed rotary pump 2 and the vacuum chamber 1 to prevent the molecules of oil from invading the vacuum chamber 1. This makes the construction of the vacuum system still more complex. A CVD apparatus uses a reactive gas, such as a hydride, and the active principle of the gas causes decomposition and deterioration of the oil of the vacuum pump, making it necessary to regularly replace the old oil by a new one. This requires a lot of labor and expenses for effecting maintenance.

An object of this invention is to provide a screw type vacuum pump capable of achieving pressures of $10^{-1}$ to $10^{-4}$ Torr level by a single stage.

Another object is to provide a screw type vacuum pump capable of achieving a medium vacuum with pressures of $10^{-2}$ to $10^{-4}$ Torr by a simple construction.

In accordance with the invention a male rotor and a female rotor, with intermeshing helical lands and grooves, cooperate with each other in casings and provide working chambers which provide a gas compression region in which the volume of the working chambers is reduced as the male and female rotors rotate to perform operations of compressing and discharging the gas and a transfer region in which the volume of the working chambers essentially shows no change even if the male and female rotors rotate, and that the working chambers of the gas compression region and the working chambers of the transfer region constitute pairs of working chambers, each pair of working chambers constituting a pair of proportions with respect to one of a plurality of grooves of the male and female rotors.

DETAILED DESCRIPTION

The principles of the invention will be described before describing the preferred embodiments.

Figure 1:
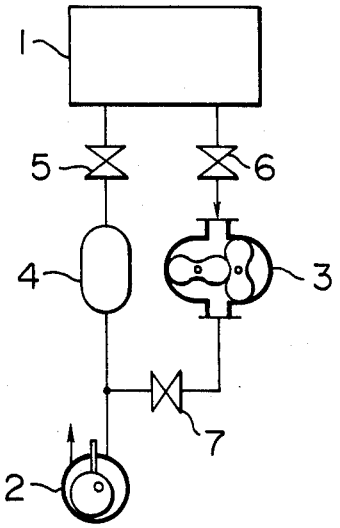
FIG. 1 PRIOR ART
FIG. 1 is a systematic view of a vacuum pump unit of the prior art.
Figure 2:
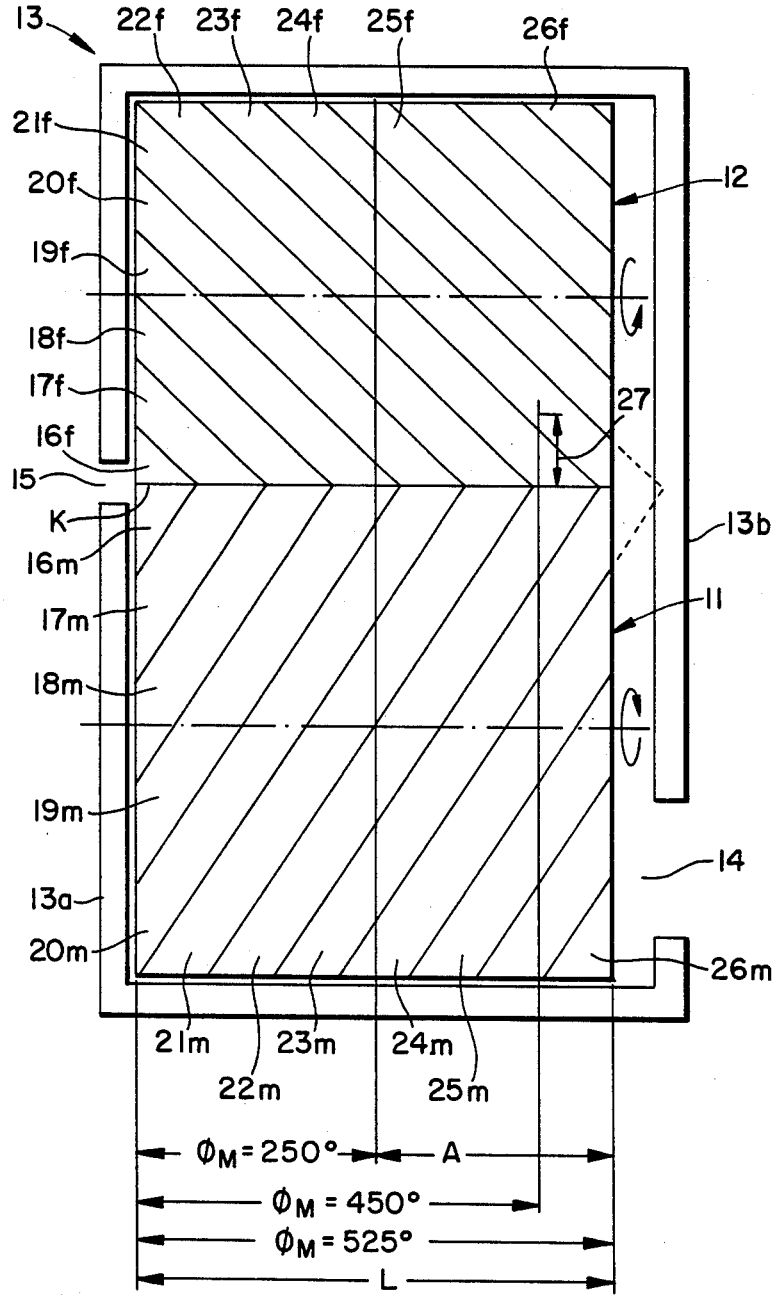
FIG. 2 is a view of a model of the screw type vacuum pump according to the invention, showing the two rotors in a developed condition.
Figure 3:
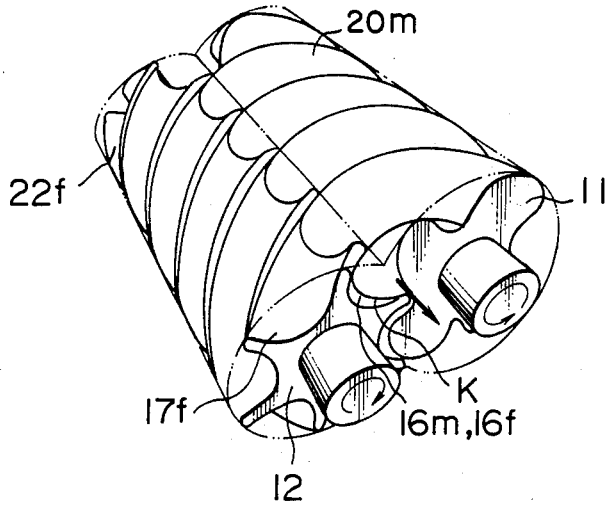
FIG. 3 is a perspective view of the two rotors of the screw type vacuum pump shown in FIG. 2, showing the two rotors in meshing engagement with each other.

As shown in FIG. 2, a screw type vacuum pump according to the invention, includes a male rotor 11 and a female rotor 12 maintained in meshing engagement with each other, with the pump being developed peripherally of the male and female rotors 11 and 12. In FIG. 2, the male rotor 11 and the female rotor 12 differ from each other in the number of lands by one (1) land, the former having five (5) lands and the latter six (6) lands. The invention is not limited to the specific number of lands of the male and female rotors, and the rotors each may have any number of lands as desired. As shown in FIG. 3, the male rotor 11 and female rotor 12 are maintained in meshing engagement with each other, with the male rotor 11 having four (4) lands and the female rotor 12 having six (6) lands with the difference in the number of lands being two (2).

The male rotor 11 and female rotor 12 are contained in a casing generally designated by the reference numeral 13 including a main casing 13*a* and a suction side casing 13*b* having a suction port 14 formed therein and a discharge port 15 formed in the main casing 13*a*. Sealing portions at opposite ends of the two rotors are constituted by wall portions of the main and side casing 13*a*, 13*b* facing opposite end faces of the rotor 11, 12. Except at the two ports 14, 15, the casing 13 encloses the rotors 11, 12 with a minuscule clearance therebetween so as to define working chambers of the V-shape between the rotors 11, 12 and the casing 13.

As the rotors 11, 12 rotate, portions of the rotors 11, 12, maintained in meshing engagement with each other, move from the suction port 14 toward the discharge port 15. Working chambers 16*m* to 20*m* and 16*f* to 21*f* have their volume reduced to compress the gas therein while working chambers 21*m*, 22*m*, and 22*f* continue to perform the operation of transferring the gas because no gas is compressed therein due to their volume being constant.

Working chambers 23*m* to 26*m* and 23*f* to 26*f*, communicating with the suction port 14, perform the operation of drawing the gas by suction because their volume increases as the rotors 11, 12 rotate.

When a screw type fluid machine is used as a compressor, the transfer region is not necessary and the suction region and compression region have only to be utilized. For example, an oilless screw compressor has the following specifications: the wrap angle $\delta_M$ of the male rotor, 250°, and the ratio of the length L of the male rotor to the diameter $D_M$ thereof $L/D_M=1.25$. As geometrical studies clearly show, the wrap angle of the rotor may be less than 360° when the suction region and compression region are utilized. Thus, the following values are usually selected in a screw compressor: $\phi_M=200°$ to 300°, and $L/D_M=1.0$ to 1.7. In FIGS. 2 and 3, the working chambers 16*m*, 16*f* are discharging the gas through the discharge port 15 and the pressure in these chambers which are equal to the discharge pressure are the highest pressures in all other working chambers. Part of the leakage gas from the working chambers 16*m*, 16*f* flows along clearances between the crests of each rotors and the barrel wall of casing 13 and clearances between end faces of the rotors 11, 12 and the casing 13 to the adjacent working chambers 17*m*, 17*f*, and another part flows through the meshing portions K of the rotors 11, 12 from the surface of FIG. 2 to an underlying surface or to the working chamber 21*m* of the male rotor 11 side and the working chamber 22*f* of the female rotor 12 side. As noted hereinabove, the wrap angle of the rotor of the screw compressor is less than 360°, the working chambers 21*m*, 22*f* are directly maintained in communication with the suction port 14. Thus, the performance of the screw compressor may vary greatly depending on the sealing effects achieved in the meshing portions of the rotors 11, 12. With regard to the outer clearances of the rotors 11, 12, gas leakage therealong would be relatively small because many sealing portions i.e., five (5) sealing portions in the male rotor 11 and six (6) sealing portions in the female rotor 12 in FIG. 2, and four (4) sealing portions in the male rotor 11 and six (6) sealing portions in the female rotor 12 in FIG. 3, are formed between the suction port 14 and discharge port 15.

As noted hereinabove, a compressor and a vacuum pump essentially have similar aspects, but a great difference between them resides in the fact that gases in vacuum condition are distinct in nature from each other in pressure level.

Figure 4:
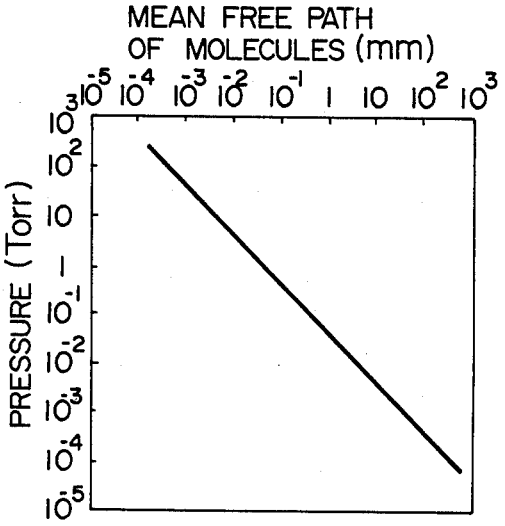
FIG. 4 is a diagram showing the relationship between pressure and the mean free path of molecules.
Figure 5:
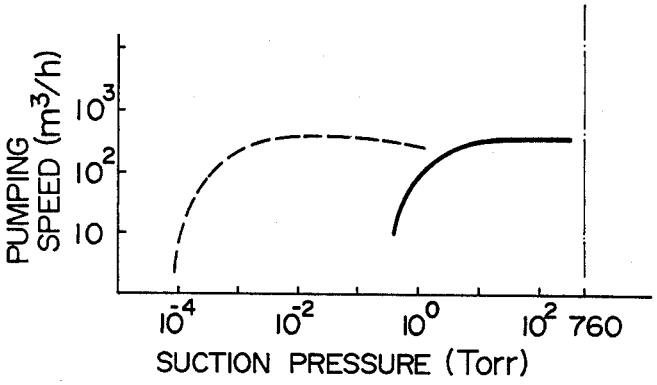
FIG. 5 is a diagram showing the relationship between the pumping speed and the suction pressure.

FIG. 4 shows the relation between the mean free path and the pressure of nitrogen molecules which are the principal constituents of air. When the pressure goes down, the mean free path of the molecules increases, and its value is about 0.05 mm when the pressure falls to 1 Torr. Clearances in various portions of the screw type vacuum pump are about 0.1 to 0.05 mm as is the case with the screw compressor, so that the mean free path of the gas molecules is less than the clearances in various portions of the screw type vacuum pump when the pressure is reduced from atmospheric pressure to 1 Torr. Thus, flows of the gas through these clearances can be treated as viscous flows in the same manner as in the screw compressor. Meanwhile, when the pressure is below 1 Torr, the mean free path of the molecules of the gas becomes greater than the clearances in various portions, with the result that flows of the gas become intermediate or molecular flows. In these regions, the molecules of the gas leak with difficulty through the clearances in various portions, so that it is possible for the screw type vacuum pump to perform a satisfactory pumping action merely by catching the molecules of the gas flying in the space and transferring same. Thus, if rotors consisting of a transfer section designated by A in FIG. 2 were rotated in a casing having open opposite ends to discharge the gas from the suction side to the discharge side, a characteristic substantially similar to that indicated by a pumping curve shown in a broken line in FIG. 5 could be obtained when the back pressure on the discharge side is 1 Torr.

Therefore, in FIG. 2, the wrap angle of the male rotor 11 is increased to $\phi_M=525°$ (in FIG. 3, $\phi_M=500°$). Then, there are two rotor meshing portions in the working chambers between the suction port 14 and discharge port 15.

The wrap angle $\phi_M$ which meet these requirements can be obtained by the following equation:

$$\phi_M = 360° \times \frac{\text{No. of Lands of Female Rotor} + 1}{\text{No. of Lands of Male Rotor}} + \alpha$$

where $\alpha$ is the rotational angle through which the female rotor rotates from the time a certain working chamber is brought into communication with the discharge port until the time the volume of the working chamber becomes zero, and its value is equal to or smaller than that of the angle corresponding to the grooves of the female rotor $$\left(\frac{360°}{\text{No. of Lands of Female rotor}}\right).$$

Using the rotors with wrap angles according to the former equation and when the pressure in the working chambers 16*m* and 16*f* is the atmospheric pressure, it is possible to reduce the pressure in the working chambers 21*m* and 22*f* to the 1 Torr level and it is possible to achieve pressures of $10^{-4}$ Torr in the suction port 14. Thus, it is possible to achieve ultimate pressure to the $10^{-4}$ Torr level by using a vacuum pump in a single stage.

When the wrap angle $\phi_M$ of the male rotor 11 is smaller than 525° or when $\phi_M=450°$ as shown in FIG. 2 (in FIG. 3, $\phi_M=500°$), for example, the working chamber 22*f* of the female rotor 12 would be brought into direct communication with the suction port 14, but by enclosing a region designated by the reference numeral 27 in FIG. 2 by a suction casing, it would be possible to maintain this working chamber 22*f* from direct communication with the suction port.

The upper limit of angles in which the end face of the female rotor 12 on the suction side can be closed as described hereinabove is an angle corresponding to the difference between the female rotor 12 and male rotor 11 in the number of lands $$\left(360^\circ \times \frac{\text{No. of Lands of Female Rotor} - \text{Number of Lands of Male Rotor}}{\text{No. of Lands of Female Rotor}}\right).$$

The pressure in the working chambers 17*m* and 17*f* is lower than that in the working chambers 16*m* and 16*f*, but it is considerably higher than that in the working chambers 21*m* and 22*f*. Thus, to prevent leakage gas from the working chambers 17*m*, 17*f* to the working chamber 23*f* flowing directly to the suction port 14, the length of the rotors might be increased as indicated by broken lines in FIG. 2.

By increasing the wrap angle of the rotor as noted hereinabove to increase the number of meshing portions, it would be possible to minimize leaks of the gas and improve the characteristics of the vacuum pump. However, the pump would be large and high in cost, and an increase in the axial length of the rotors might cause the problem of vibration of the shaft. A reduction in the wrap angle of the rotor could reduce the size and cost of the vacuum pump, but the characteristics of the pump might be deteriorated.

The wrap angle $\phi_M$, the length $L/D_M$ and the number of lands of the rotors are decided by taking into consideration the characteristics, costs and dimensions of the vacuum pump. One of the features of the invention is that each working chamber has two to three sealed portions between the suction port and discharge port.

The sealing portions may comprise a first sealing portion separating working chambers in a suction stroke from working chambers in a transfer region, and a second sealing portion separating the working chambers in the transfer region from working chambers in a gas compression region or a discharge stroke. The first and second sealing portions are both constituted by meshing portions of the two rotors.

The sealing portions may comprise first and second sealing portion providing working chambers in the transfer region, and second and third sealing portions providing working chambers just before entering the gas compression region. The first sealing portion is constituted by a casing while the second and third sealing portions are constituted by meshing portions of the two rotors. Stated differently, the working chamber in the transfer region in which suction and transfer are performed and the working chamber in the gas compression region in which gas compression is performed are located along an arbitrarily selected one of the grooves of the rotors and constitute a pair of working chambers each located along one of the grooves of the rotors. As the rotors rotate, the pair of working chambers move axially of the pump so that the working chambers of the transfer region become working chambers of the gas compression region in which compression and discharge take place during operation of the pump and working chambers of the transfer region are newly formed in the suction port side. This applies to all other pairs of working chambers. The period of time during which the working chambers defined by the two rotors and the casing remain in the transfer region in which they are brought out of communication with the suction port is preferably set between the time at which the working chambers performing compression and discharge begin to have their volume reduced and the time at which such working chambers are brought into communication with the discharge port.

When the difference between the two rotors in the number of lands is two (2), the working chambers in the transfer region formed in each groove of the rotors are communicated with the working chambers of the next following transfer region at the meshing portions of the two rotors, so that the working chambers of the contiguous transfer regions constitute working chambers of a single transfer region. That is, although a closed transfer region is not formed for each groove of the rotors, the transfer function can be performed. Also, the working chambers in each gas compression region have one end thereof closed by the casing, so that the working chambers of the gas compression regions are not brought into communication with each other and they are each formed independently in one of the grooves of the rotors.

Figure 6:
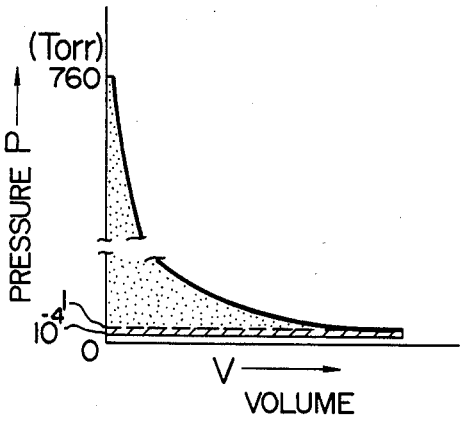
FIG. 6 is a diagram showing the work for a vacuum pump to achieve pressures of $10^{-4}$ Torr from the atmospheric pressure.

Considering the pumping work to achieve pressures of $10^{-4}$ Torr by evacuating a chamber in which the atmospheric pressure prevails according to thermodynamical analysis, it is not difficult to find that the work necessary for internal compression change is smaller than that for no internal compression change. In FIG. 6, the pumping work to raise pressure from $10^{-4}$ Torr to 1 Torr is represented by a hatched area which is so small as compared with a dotted area representing the pumping work to raise pressure from 1 Torr to 760 Torr that it can be neglected. Therefore, no internal compression is required while the pressure is being raised from $10^{-4}$ Torr to 1 Torr. However, the pumping work can be greatly reduced if internal compression is performed while the pressure is being raised from 1 Torr to 760 Torr.

Figure 7:
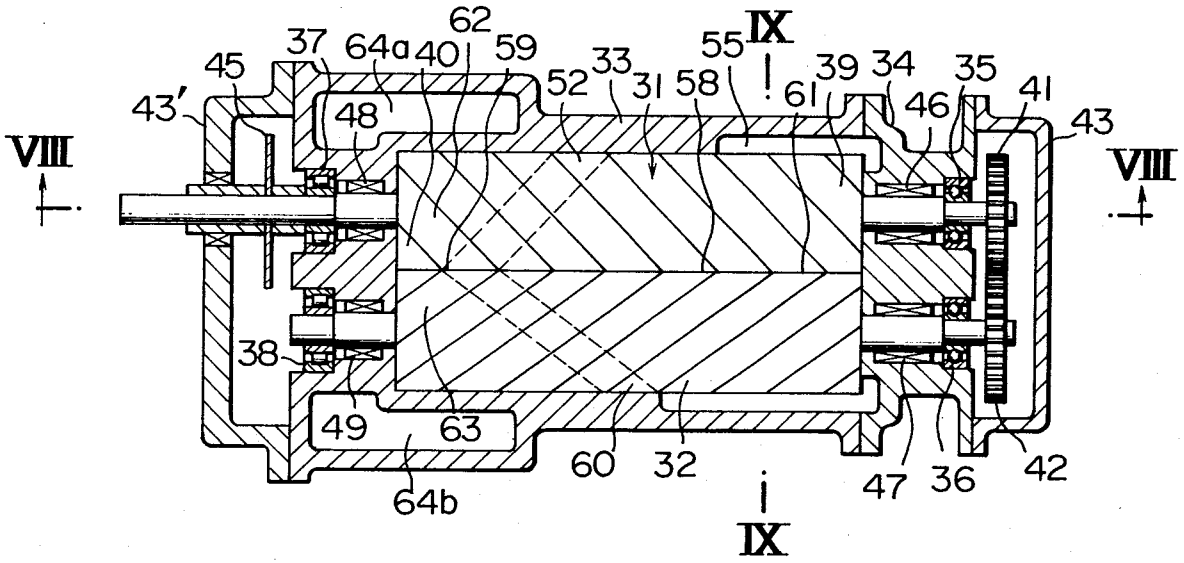
FIG. 7 is a transverse sectional view of one embodiment of the screw type vacuum pump in accordance with the invention.
Figure 8:
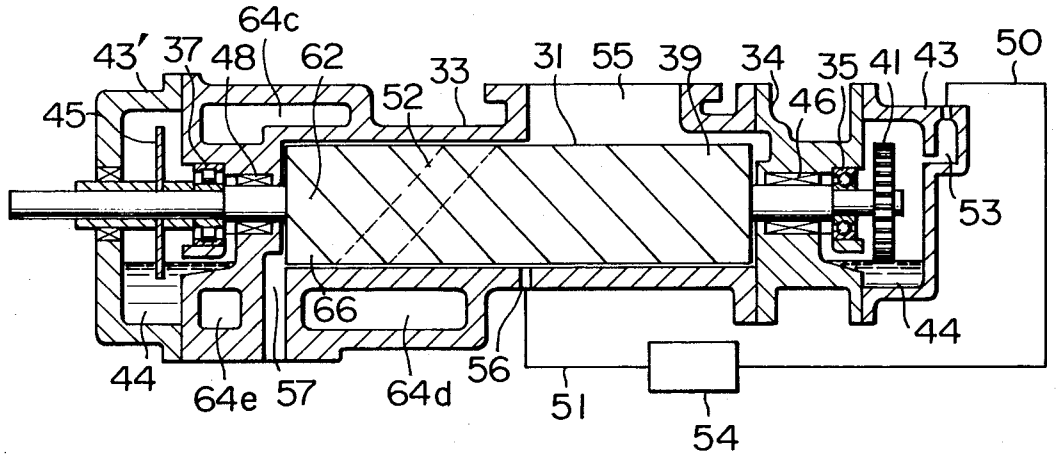
FIG. 8 is a sectional view taken along the line VIII—VIII in FIG. 7.
Figure 9:
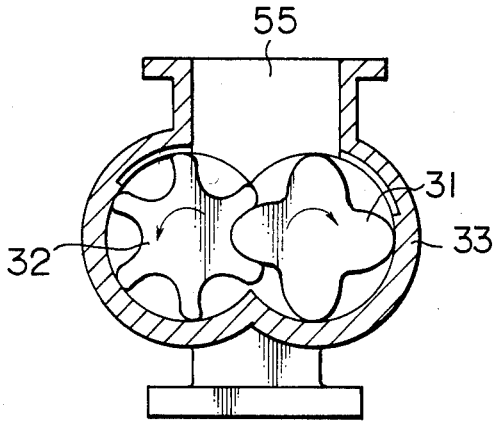
FIG. 9 is a sectional view taken along the line IX—IX in FIG. 7.

As shown in FIGS. 7–9, a male rotor 31 having four (4) lands and a female rotor 32 having six (6) lands are carried by bearings 35, 36, 37 and 38 for rotation in a main casing 33 and a suction casing 34. The wrap angle of the male rotor 31 is 650°, and that of the female rotor 32 is about 433°. During steadystate operation, pressures on a suction side 39 of the rotors 31 and 32 are low or at the $10^{-4}$ Torr level and those on a discharge side 40 thereof are at the atmospheric pressure level, so that a much smaller radial load is applied to the rotors 31 and 32 on the suction side 39 than on the discharge side 40. Thus, deep-grooved ball bearings are used as the bearings 35 and 36 on the suction side 39 and cylindrical roller bearings are used as the bearings 37 and 38 on the discharge side 40 to bear only the radial load. Timing gears 41 and 42 forming a pair are each attached to one end of a shaft supporting the rotor 31 or 32, to regulate the clearance between the two rotors 31 and 32 to keep them from contacting each other. Lubrication of the bearings 35 and 36 is effected by feeding lubricating oil 44 collecting in a suction cover 43 by splashing same by means of the timing gears 41 and 42. Meanwhile, the shaft of the male rotor 31 mounts a disc 45 for lubricating the bearings 37 and 38, so that the disc 45 splashes the lubricating oil 44 in a discharge cover 43' on to the bearings 37 and 38. Shaft sealings 46, 47, 48 and 49 avoid invasion of working chambers by the lubricating oil from the bearings and timing gears. Working chambers 40 on the discharge side of the rotors 31 and 32 and the discharge cover 43' are substantially atmospheric in pressure, so that differential pressure applied to the shaft sealings 48 and 49 on the discharge side is relatively low. However, working chambers 39 on the suction side has a pressure which is at the $10^{-4}$ Torr level. Thus, if the suction cover 43 were exposed to the atmosphere, difficulties would be experienced in sealing the shaft because of an increase in differential pressure acting on the shaft sealings 46 and 47 on the suction side. Therefore, the suction cover 43 is communicated through connecting pipes 50 and 51 with a working chamber 52 of low or medium pressure level so as to reduce the pressure in the suction cover 43, to thereby increase the effects achieved in sealing the shafts by reducing the pressure differential applied to the shaft sealings 46, 47. The suction cover 43 is filled with droplets of lubricating oil 44, so that the suction cover 43 is provided with an oil droplets separating chamber 53 to avoid the oil entering working chambers through the connecting pipes 50, 51. An oil trap 54 is mounted in the connecting pipes 50, 51 to ensure that no lubricating oil enters the working chambers. A connecting port 56 communicating with the main casing 33 is located in a position in which the working chamber 52 is fully out of communication with a suction port 55, so that the lubricating oil will not flow backwardly to the suction port 55 in the event that the lubricating oil has flowed through the connecting pipes 50, 51 to the working chambers. The working chamber 52 of the male rotor 31 has two meshing portions 58, 59 at which it meshes with the female rotor 32 after the working chamber 52 has passed out of communication with the suction port 55 and before it is brought into communication with a discharge port 57. Likewise, a working chamber 60 of the female rotor 32 has two meshing portions 61 and 59 at which it is brought into meshing engagement with the male rotor 31.

As the rotors 31, 32 rotate, the gas is drawn through the suction port 55 into working chambers defined by the lands of the rotors and the casings, and discharged through the discharge port 57. The working chambers 52 and 60 transfer the gas while their volume remains constant. However, working chambers 62, 63 located in a position in which the rotors 31, 32 have further rotated have their volume reduced to compress the gas as the rotors 31, 32 rotate, and the gas temperature rises at the discharge side. To cope with this situation, cooling jackets **64*a*–64*e* are mounted to the discharge side of the casing 33**, and cooling water is passed to the jackets to cool the casing and compressed gas.

Figure 10:
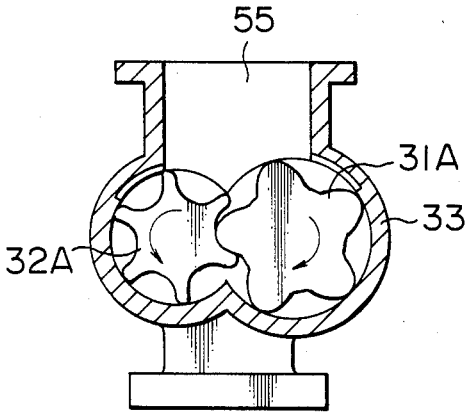
FIG. 10 is a sectional view perpendicular to the rotor axis of another embodiment of the screw type vacuum pump in conformity with the invention.

FIG. 10 shows another embodiment of the invention which is distinct from the embodiment shown in FIGS. 7, 8 and 9 in that the female rotor 32A has six (6) lands and the male rotor 31A has five (5) lands.

Figure 11:
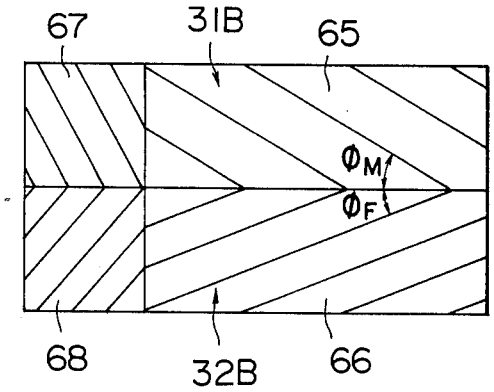
FIG. 11 is a view showing portions of still another embodiment of the screw type vacuum pump in accordance with the invention.

FIG. 11 shows portions of still another embodiment, which will be described only with regard to its rotor, other parts being similar to those shown in FIGS. 7 and 8. A vacuum pump has a larger specific volume of a gas on the suction side than on the discharge side. Thus, to increase the pumping speed of the vacuum pump would require an increase in the volume of working chambers performing suction and transfer of the gas and a decrease in the volume of working chambers performing compression thereof. In FIG. 11, the male rotor 31B and female rotor 32B comprise suction and transfer groove 65, 66 and compression grooves 67 and 68 respectively. The suction and transfer grooves 65 and 66 are smaller in the helix angles $\psi_M$ and $\psi_F$ of the rotors and greater in L/D than the compression grooves 67 and 68. Thus, the vacuum pump using the rotors shown in FIG. 11 has a large pumping speed even if the vacuum pump is equal in size to the vacuum pump shown in FIG. 7.

The embodiment shown and described hereinabove has two (2) or three (3) sealing portions. However, the invention is not limited to these specific numbers of sealing portions and the vacuum pump according to the invention may have three (3) or four (4) sealing portions including two (2) sealing portions provided by the meshing portions of the two rotors at all times. The vacuum pump having three (3) or four (4) sealing portions would have working chambers for performing compression and discharge, first working chambers for performing transfer located contiguous with the working chambers for compression and discharge via sealing portions provided by the meshing portions of the two rotors, and second working chambers for performing transfer located contiguous with the first transfer working chambers via sealing portions provided by the meshing portions of the two rotors, each of the working chambers being located along an arbitrarily selected groove of one of the two rotors between the suction port and the discharge port of the vacuum pump.

The provision of the two working chambers for performing transfer to one groove of each rotor reduce leakage of the gas, thereby enabling a higher vacuum to be obtained.

From the foregoing description, it will be appreciated that the oilless vaccum pump comprising one of the embodiments of the invention has a greatly improved pumping characteristic. Thus, the vacuum pump according to the invention it capable in single stage to achieve desired pressures in a wide range between the atmospheric pressure level and $10^{-4}$ Torr level or between the atmospheric pressure level and a medium vacuum level.

By using the vacuum pump according to the invention, it is possible to provide a vacuum system which is simpler in construction and lower in cost than the vacuum system of the prior art using an oil-sealed rotary pump and a mechanical booster pump. The use of a vacuum system of simple construction makes it possible to use a control system of simple construction and low cost because the need to perform complicated operations in turning on and off valves, for example, is eliminated.

What is claimed is:

1. A screw vaccum pump comprising:

a male rotor having a plurality of spiral lands and grooves and a shaft portion and operative to rotate about said shaft portion;

a female rotor having a plurality of spiral lands and grooves and a shaft portion and operative to rotate about said shaft portion while being maintained in meshing engagement with said male rotor; and casings defining a space for containing said two rotors and providing a suction port and a discharge port communicating with said space;

said two rotors each having a wrap angle related to the position of said suction port and the position of said discharge port, said wrap angles being greater than 360°;

a plurality of working chambers defined by said two rotors and said casings including a plurality of sealed working chambers out of communication with both the suction port and the discharge port, said plurality of sealed working chambers comprising a plurality of working chambers having their volume reduced when the two rotors rotate while being maintained in meshing engagement with each other, and a plurality of working chambers having their volumes maintained substantially constant when the two rotors rotate while being maintained in meshing engagement with each other, and wherein at least one of said working chambers having their volume reduced and at least one of said working chambers having their volume maintained substantially constant are provided in each of the grooves and separated from each other by meshing portions of said two rotors.

2. A screw vacuum pump as claimed in claim 1, wherein the wrap angle $\phi_M$ of the lands of said male rotor is less than 650°, and the female rotor has a wrap angle of the lands suitable to bring the female rotor into meshing engagement with the male rotor.

3. A screw vacuum pump as claimed in claim 1, wherein a sealing portion at one end of said working chambers having their volumes kept substantially constant is constituted by one of the meshing portions of the two rotors and a sealing portion at an opposite end thereof is constituted by a wall of the casing facing opposite end faces of the two rotors.

4. A screw vacuum pump as claimed in claim 3, wherein the lands and grooves of said male rotor are less than those of the female rotor by two lands and two grooves.

5. A screw vacuum pump as claimed in claim 4, wherein the lands and grooves of said male rotor are four in number, and those of said female rotor are six in number.

6. A screw vacuum pump as claimed in claim 3, wherein the lands and grooves of said male rotor are four in number, and those of said female rotor are six in number.

7. A screw vacuum pump as claimed in claim 6, wherein the wrap angle $\phi_M$ of the lands of said male rotor is less than 650°, and the female rotor has a wrap angle of the lands suitable to bring the female rotor into meshing engagement with the male rotor.

8. A screw vacuum pump as claimed in claim 7, wherein said male rotor has a wrap angle $\phi_M$ of the lands which is about 600°.

9. A screw vacuum pump comprising:

a male rotor having a plurality of spiral lands and grooves and a shaft portion and operative to rotate about said shaft portion;

a female rotor having a plurality of spiral lands and grooves and a shaft portion and operative to rotate about said shaft portion while being maintained in meshing engagement with said male rotor, said lands of said female rotor being greater by one land than those of said male rotor; and casings defining a space for containing said two rotors and providing a suction port and a discharge port communicating with said space;

wherein the improvement comprises:

a plurality of working chambers defined by said two rotors and casings comprising a plurality of sealed working chambers out of communication with both the suction port and the discharge port, said plurality of sealed working chambers including at least two sealed working chambers located in one of said grooves of each said rotor and located along each said groove, said rotors each having a wrap angle greater than 360°, one of said at least two sealed working chambers being a working chamber having its volume varied as said two rotors rotate while being in meshing engagement with each other and the rest of said at least two sealed working chambers being working chambers undergoing substantially no change in volume when said two rotors rotate, and wherein said at least two sealed working chambers are separated from each other by meshing portions of said two rotors.

10. A screw vacuum pump as claimed in claim 9, wherein a sealing portion at one end of said working chambers having their volumes kept substantially constant is constituted by one of the meshing portions of the two rotors and a sealing portion at an opposite end thereof is constituted by a wall of the casing facing opposite end faces of the two rotors.

11. A screw vacuum pump as claimed in claim 9, wherein said plurality of working chambers defined by the grooves of the rotors are a pair of working chambers, one of which is a working chamber having its volume vary when the rotors rotate, and the other is a working chamber having its volume kept substantially constant when the rotors rotate.

12. A screw vacuum pump as claimed in claim 11, wherein a sealing portion at one end of said working chambers having their volumes kept substantially constant is constituted by one of the meshing portions of the two rotors and a sealing portion at an opposite end thereof is constituted by a wall of the casing facing opposite end faces of the two rotors.

13. A screw vacuum pump as claimed in claim 11, wherein the lands and grooves of the male rotor are five (5) in number, and those of the female rotor are six (6) in number.

14. A screw vacuum pump as claimed in claim 13, wherein the wrap angle $\phi_M$ of the lands of said male rotor is about 525°, and the wrap angle of the teeth of the female rotor is suitable to bring the female rotor into meshing engagement with the male rotor.

15. A screw vacuum pump as claimed in claim 13, wherein the wrap angle $\phi_M$ of the lands of the male rotor is less than 520°, and the female rotor has a wrap angle of the lands suitable to bring the female rotor into meshing engagement with the male rotor, said female rotor having a portion of its end face on the suction side closed by one of said casings.

16. A screw vacuum pump as claimed in claim 15, wherein the wrap angle $\phi_M$ of the lands of the male rotor is 450°, and the female rotor has a wrap angle of the lands suitable to bring the female rotor into meshing engagement with the male rotor.

17. A screw vacuum pump comprising:

a male rotor having a plurality of spiral lands and grooves and a shaft portion and operative to rotate about said shaft portion;

a female rotor having a plurality of spiral lands and grooves and a shaft portion and operative to rotate about said shaft portion while being maintained in meshing engagement with said male rotor; and casings defining a space for containing said two rotors and providing a suction port and a discharge port communicating with said space;

said two rotors each having a wrap angle related to the position of said suction port and the position of said discharge port;

a plurality of working chambers defined by said two rotors and said casings including a plurality of sealed working chambers out of communication with both the suction port and the discharge port, said plurality of sealed working chambers comprising a plurality of working chambers having their volume reduced when the two rotors rotate while being maintained in meshing engagement with each other, and a plurality of working chambers having their volumes maintained substantially constant when the two rotors rotate while being maintained in meshing engagement with each other, and wherein at least one of said working chambers having their volume reduced and at least one of said working chambers having their volume maintained substantially constant are provided in each of the grooves and separated from each other by meshing portions of said two rotors, wherein said male rotor has a wrap angle $\phi_M$ of the lands expressed by the following formula:

$$\phi_M = 360° \times \frac{\text{No. of Lands of Female Rotor} + 1}{\text{No. of Lands of Male Rotor}} + \alpha$$

where $\alpha$ is the rotational angle of the rotor through which the rotor rotates from the time one of the working chambers having volume thereof reduced is brought into communication with the discharge port until the time the volume of the working chamber becomes zero.

18. A screw vacuum pump as claimed in claim 17, wherein the male rotor has a wrap angle $\phi_M$ of the lands which is 650°, and the female rotor has a wrap angle of the lands suitable to bring the female rotor into meshing engagement with the male rotor.

19. A screw vacuum pump comprising:

a male rotor having a plurality of spiral lands and grooves and a shaft portion and operative to rotate about said shaft portion;

a female rotor having a plurality of spiral lands and grooves and a shaft portion and operative to rotate about said shaft portion while being maintained in meshing engagement with said male rotor, said lands of said female rotor being greater by one land than those of said male rotor; and casings defining a space for containing said two rotors and providing a suction port and a discharge port communicating with said space;

wherein the improvement comprises:

a plurality of working chambers defined by said two rotors and casings comprising a plurality of sealed working chambers out of communication with both the suction port and the discharge port, said plurality of sealed working chambers including at least two sealed working chambers located in one of said grooves of each said rotor and located along each said groove, one of said at least two sealed working chambers being a working chamber having its volume varied as said two rotors rotate while being in meshing engagement with each other and the rest of said at least two sealed working chambers being working chambers undergoing substantially no change in volume when said two rotors rotate, and wherein said at least two sealed working chambers are separated from each other by meshing portions of said two rotors, wherein said male rotor has a wrap angle $\phi_M$ of the lands expressed by the following formula:

$$\phi_M = 360° \times \frac{\text{No. of Lands of Female Rotor} + 1}{\text{No. of Lands of Male Rotor}} + \alpha$$

where $\alpha$ is the rotational angle of the rotor through which the rotor rotates from the time one of the working chambers having a volume thereof reduced is brought into communication with the discharge port until the time the volume of the working chamber becomes zero.

* * * * *